US006126756A

United States Patent [19]

Varner

[11] Patent Number: 6,126,756

[45] **Date of Patent: *Oct. 3, 2000**

[54] METHOD AND APPARATUS FOR REMOVING STANDING WATER FROM FLAT AND CONTOURED SURFACES AND FROM TEXTURED AND PATTERNED SURFACES

[75] Inventor: Donald Dean Varner, Hollister, Calif.

[73] Assignee: Goldtime Products LLC, Hollister, Calif.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 09/059,661

[22] Filed: Apr. 13, 1998

Related U.S. Application Data

[63] Continuation-in-part of application No. 08/859,836, May 16, 1997, Pat. No. 5,920,947.

[51] Int. Cl.[7] ..... B08B 1/00; A47L 1/06

[52] U.S. Cl. ..... 134/6; 15/245; D32/41

[58] Field of Search ..... 15/236.01, 236.02, 15/245, 245.1, 250.41, 250.48; 134/6; D32/41

[56] References Cited

U.S. PATENT DOCUMENTS

| | | | |
|---|---|---|---|
| D. 28,990 | 7/1898 | Cumming | 15/245 X |
| 229,430 | 6/1880 | Linscott | 15/245 |
| 2,158,695 | 5/1939 | Foss | 15/245 |
| 2,814,062 | 11/1957 | Griesen | 15/245 |
| 3,676,888 | 7/1972 | Akers | 15/245 |
| 4,010,513 | 3/1977 | Sassi | 15/245 |
| 4,107,812 | 8/1978 | Lantto | 15/245 |
| 4,386,443 | 6/1983 | Kubick | 15/245 |
| 5,101,530 | 4/1992 | Hansen et al. | 15/245 |
| 5,349,716 | 9/1994 | Millar | 15/245 |

FOREIGN PATENT DOCUMENTS

| | | | |
|---|---|---|---|
| 2313743 | 10/1974 | Germany | 15/250.48 |

*Primary Examiner*—Mark Spisich
*Attorney, Agent, or Firm*—Donald R Boys; Central Coast Patent Agency

[57] ABSTRACT

A water-wiping blade for wiping water from surfaces having projecting regions from the surface is based on a flexible panel having an upper and a lower long edge, with a handle interface along the upper long edge, and a lip formed along the lower long edge, the lip ending in a sharp line at the end away from the flexible panel. In a preferred embodiment a handle is attached by the handle interface along the upper long edge. By rotating the flexible panel around the handle length and urging the panel into a surface, the lip can be caused to wrap around regions projecting from the surface with the sharp line of the lip in contact with the surface. Translating the panel then is effective in wiping standing water from the surface even in the presence of such surface deformities, such as rivet heads and the like. In some embodiments handle extensions may be used to allow positioning the flexible panel in hard-to-reach places. Also in some embodiments a lip is provided to both sides of the flexible panel so either side may be used for wiping water, and lips of various shapes are taught.

18 Claims, 13 Drawing Sheets

METHOD AND APPARATUS FOR REMOVING STANDING WATER FROM FLAT AND CONTOURED SURFACES AND FROM TEXTURED AND PATTERNED SURFACES

CROSS-REFERENCE TO RELATED DOCUMENTS

The present application is a continuation-in-part (CIP) to application Ser. No. 08/859,836 filed May 16, 1997, now U.S. Pat. No. 5,920,947.

FIELD OF THE INVENTION

The present invention is in the field of car-wash accessories and pertains more particularly to hand-held devices used for removing standing water on automobiles.

BACKGROUND OF THE INVENTION

One of the largest and most lucrative product markets in the United States involves cosmetic accessories for automobiles and light trucks. There are literally thousands of products available that are dedicated to enhancing the cosmetic appearance of a consumer's pride and joy, namely, his automobile. From products that add luster to an expensive paint job, to products that add sparkle to chrome, all one has to do is visit a local parts store to see discover a broad range of such innovative products.

One category of products possibly containing the least variety from which to choose is car-wash products. Car-wash accessories known in the art include special towels for removing water and drying automobile finishes after a car-wash, or chamois cloths for absorption of excess water and the like. Other products in this category include automated hot-air blowers for quick drying the automobile finish, or various hand-held cloth or synthetic pads for rubbing excess water off of an automobiles finish.

Bottled solutions or treatments are sometimes employed as aids to reducing spotting or staining of an automobiles finish often resulting from standing water. The type of water used in washing a car plays a part in possible spotting or staining that may be present on an automobiles finish after a wash. For example, if the water is very hard (has a lot of dissolved minerals) minerals, resultant spotting can be extreme; whereas, if water is softer, spotting may be lessened. These bottled solutions or pastes are designed to reduce spotting via their interaction with the water itself.

At the time of this writing the most successful (least damaging) method known in the art for removing standing water from an automobile finish is likely the time-tested chamois cloth. The chamois is a highly flexible section of treated animal skin that has a large absorption capability. The chamois is typically used just after the automobile has been rinsed. It is laid out on a surface and pulled in the direction of the user.

Although the chamois cloth is widely accepted as a viable method for removing standing water, there are some inherent problems and limitations associated with it's use. Because of the chamois cloth's persistent adhesion to a wet surface, moving the chamois from side to side, or at directions away from the user, is difficult. The chamois cloth has a tendency to fold or roll under itself if it is not being pulled directly toward the user. This drawback limits accessibility to areas that may need to be wiped. Another problem is that, while a chamois is very successful in absorbing standing water, the chamois must be wrung out when it is loaded with water, a such cloths are difficult to wring.

Because of these difficulties several chamois cloths must often be used to completely remove standing water from an automobile finish. Although the chamois is very soft and generally harmless to a paint job or finish, it is possible that unseen dirt or particles left over from the car-wash process get lodged in the chamois and can cause scratches when the chamois is pulled across the surface of an automobile. This can be particularly disturbing for those who own expensive show cars that support special auto paints that may be susceptible to scratching.

Other types of cloths are available and well known in the art, such as re-washable towels that are sold in most auto-care shops. The absorption qualities, as well as the scratch resistant properties of these products typically vary. These towel-type products are generally intended for users who expect marginal results and are not overly concerned with the cosmetic appearance of their automobiles. Similarly, hand-held pads of the type made out of synthetic fiber vary in their absorption quality, as well as scratch resistant properties. While hand-held pads provide a convenient place for a user's hand (usually straps on the top surface), they do little else to improve the technology of water removal.

It is well known in the art that some products with rubber-like blades, such as squeegees and windshield wipers, work fairly well removing water from a flat or slightly curved surface. These devices, however, are not well adapted to removal of standing water from automobile bodies, because they cannot conform to the sometimes radical and compound curvature of an automobile body. Moreover, many body panels for vehicles such as trucks and airplanes have uneven surfaces, such as broken by rivet heads and the like, and also by intentional functional or ornamental patterns. One such pattern is a diamond shape panel that is well-known in the art and used for truck trailers and the like. Wipers are not known in the art that are efficient in removing standing water from such surfaces.

Air blowers are sometimes employed to evaporate standing water droplets on a surface. This method is most used in automated car washes and the like; and it is well known in the art that an automobile owner concerned with the cosmetic appeal of his or her vehicle would not, under normal circumstances, patronize a commercial auto-wash. Moreover, air blowers of the type that are hand-held are typically difficult because they are cumbersome, awkward, and rather heavy to hold for the time it takes to dry a car body. Furthermore, power cords can get in the way while working on an automobile surface, and cause scratches and other damage as well. In addition, electricity and or battery costs may be a deterrent to those having to wash multiple automobiles such as would be the case with a car dealership, etc.

What is clearly needed is a method and apparatus for removing standing water from surfaces that is adapted to conform around the sometimes compound and radical curvature of automobile bodies, and around rivet heads and other projections from surfaces to be dried, and is at the same time gentle to surface finishes, easy to use, inexpensive, and durable. It is to these objects and others that the present invention is dedicated, and apparatus and methods are taught herein in enabling detail for accomplishing these ends.

SUMMARY OF THE INVENTION

In a preferred embodiment of the present invention a water-wiping apparatus for wiping standing water from a surface is provided, comprising a flexible panel having a thickness, a length, and a height, with an upper long edge and a lower long edge substantially parallel; a substantially rigid handle attached along at least a portion of the upper edge; and a lip formed along the lower edge, extending to one side of the flexible panel and ending in a sharp line at the end away from the flexible panel. The lip has a shape and flexibility to conform to raised regions in the surface. In some embodiments the lip has a triangular cross-section in a plane cutting the panel orthogonal to the length and parallel to the height, in others the cross-section is rectangular. Other shapes are provided as well.

In some embodiments the flexible panel has a greater thickness at the upper edge than at the lower edge, and the panel may be molded from silicone material, or other relatively soft and flexible polymer material. The lip may extend to one side or to both sides of the flexible panel. In some embodiments there are vertical side-by-side grooves provided along the length of the flexible panel to lower the volume of material in the panel. In some embodiments a handle is adapted to be joined to a handle extension.

In some embodiments the lip ends at the edge away from the flexible panel in multiple v-shaped projections. In others there are multiple lips extending from the lower edge of the flexible panel in different directions.

In another aspect of the present invention the apparatus provided is a blade insert for a water-wiping apparatus, the blade insert distinguished by the features introduced above for the water-wiping apparatus. In other aspects methods are provided for practicing the invention.

The water-wiper according to various embodiments of the invention provides in the art for the first time an apparatus capable of removing standing water from curved and flat surfaces, even from surfaces having projecting ornamental and functional shapes and rivet heads and the like.

BRIEF DESCRIPTION OF THE DRAWING FIGURES

DESCRIPTION OF THE PREFERRED EMBODIMENTS

Figure 1:
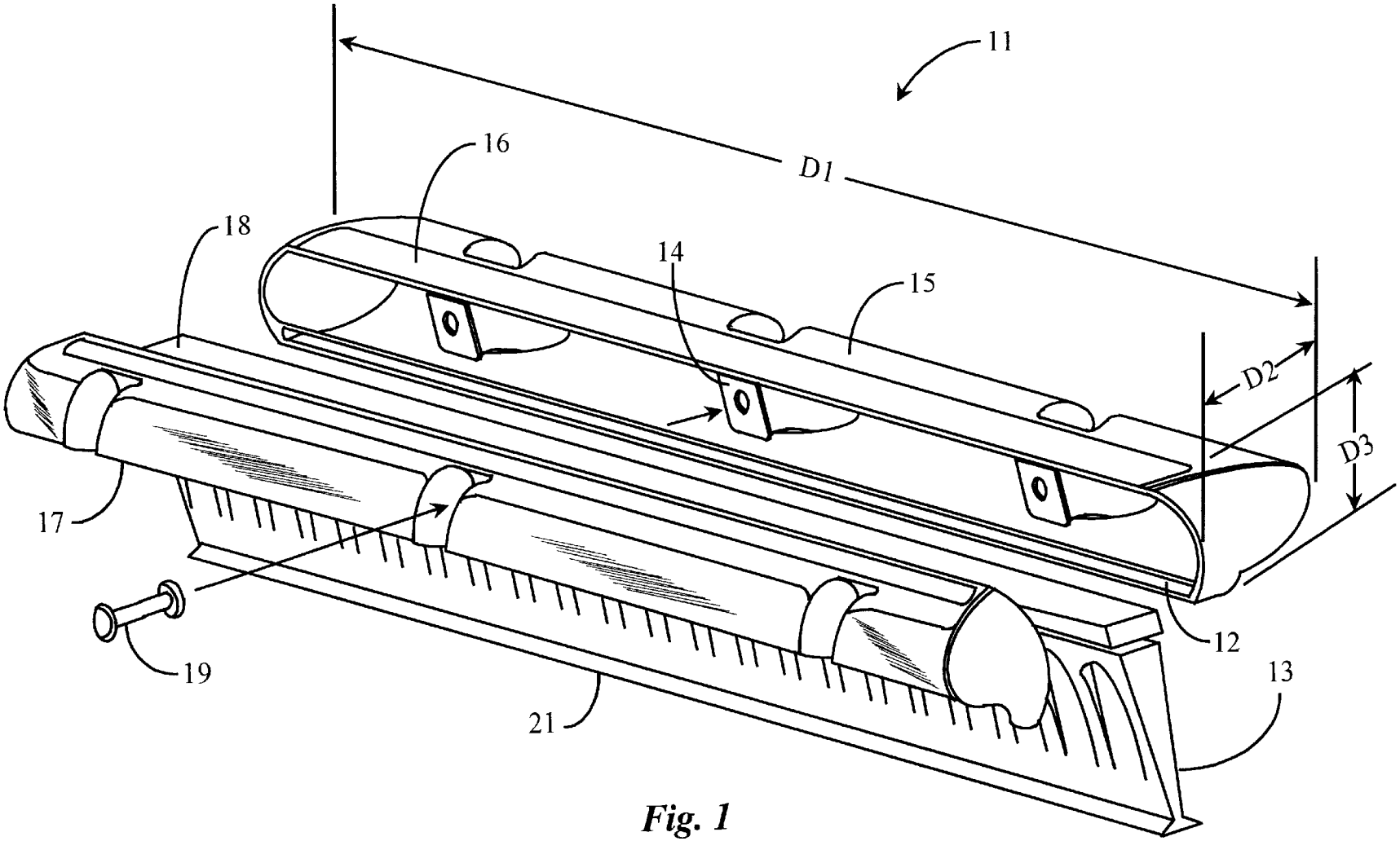
FIG. 1 is a perspective exploded view of a hand-held water blade in an embodiment of the present invention.

FIG. 1 is a perspective exploded view of a hand-held water blade 11 in an embodiment of the present invention, illustrating three main elements of the assembly of water blade 11. A two-part handle consists of a first section 15 adapted to fasten to a second section 17 with a blade insert 13 captured between the handle sections. With the handle sections joined and the blade captured, a functioning water blade 11 is formed. In a preferred embodiment of the present invention, handle sections 15 and 17 are molded from polypropylene in an injection molding process. Injection molding is well known in the art of fabricating various plastics and is considered by the inventor, in this instance, to be a preferred process for manufacturing water blade 11. In other embodiments, other fabrication methods may be employed such as gluing various parts together, or perhaps plastic welding techniques may be employed. It will be apparent to one with skill in the art that various materials may be used to fabricate handle sections 15 and 17 such as Delrin, nylon, and others. Metals, wood, and the like may be used in other embodiments.

A T-shaped top portion 18 is provided in blade insert 13 wherein opposite sides of the "T" fit snugly into opposite blade slots provided in handle sections 17 and 15. A blade retaining slot 12 is shown in handle section 15, and a similar slot is provided in section 17, though not shown in FIG. 1.

Handle sections 15 and 17 are designed to fit together to form a handle grip that retains the wiper blade, is comfortable to hold, and is of light weight. In a preferred embodiment, special texture areas are provided around the outer edges of each handle section, although this is not required. Recesses may be molded into handle sections 15 and 17 for the purpose of supporting decals, logos, and the like.

In the embodiment shown a method is provided for attachment of handle sections 15 and 17 whereby handle section 15 has assembly brackets such as bracket 14 that are designed to accept rivets such as rivet 19 that are to be inserted through access points shown in handle section 17, such as the access point shown roughly in line with rivet 19 and bracket 14 illustrated by the directional arrows. Bracket 14 may be formed in the molding process or may be mounted to handle section 15 after molding. Bracket 14 may be fabricated from aluminum, sheet metal, or any other suitable material known in the art and of suitable strength to provide a secure attachment.

In the embodiment shown by FIG. 1 the method of attachment is riveting. However, other methods of attachment may be used as well, such as screws, snap inserts and the like. In another embodiment there may be no brackets or recesses but rather grooves provided and adapted for the installation of outer snap rings. It will be apparent to one with skill in the art that many methods, well known in the art, may be employed for attaching handle sections together without departing from the spirit and scope of the present invention as described above. In still other embodiments a one-piece handle may be provided with a T-slot adapted to engage T-section 18 of blade 13, wherein the blade may be threaded into the slot of the one-piece handle. An advantage in this embodiment is that there is no need for separate sections or fasteners. In still other embodiments handles may be formed in other ways, ad some of these other ways are described in more detail below.

In a preferred embodiment of the present invention length dimension D1 is about 12 inches, width dimension D2 is approximately ⅞ of an inch, and height dimension D3 is approximately 1¼ of an inch. It will be apparent to one with skill in the art that dimensions with respect to length, width, and height of the grip handle formed by handle sections 15 and 17 may vary. For example, handles of different sizes may be provided along with blades of different sizes for use under certain circumstances. Large sizes for large trucks and trailers, for example, and smaller models for such as compact cars.

Figure 2:
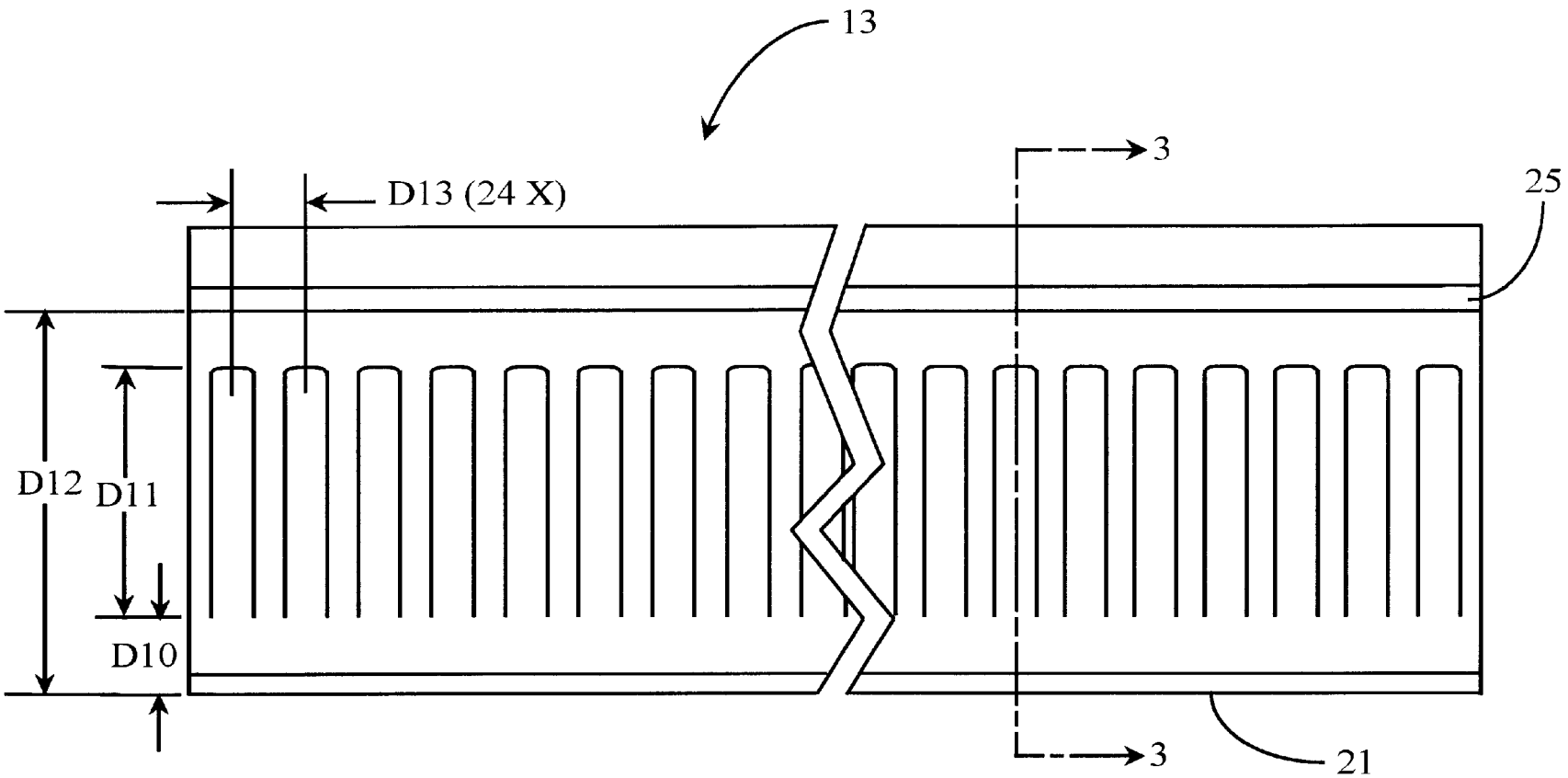
FIG. 2 is a broken view of a water blade insert in an embodiment of the present invention.
Figure 3:
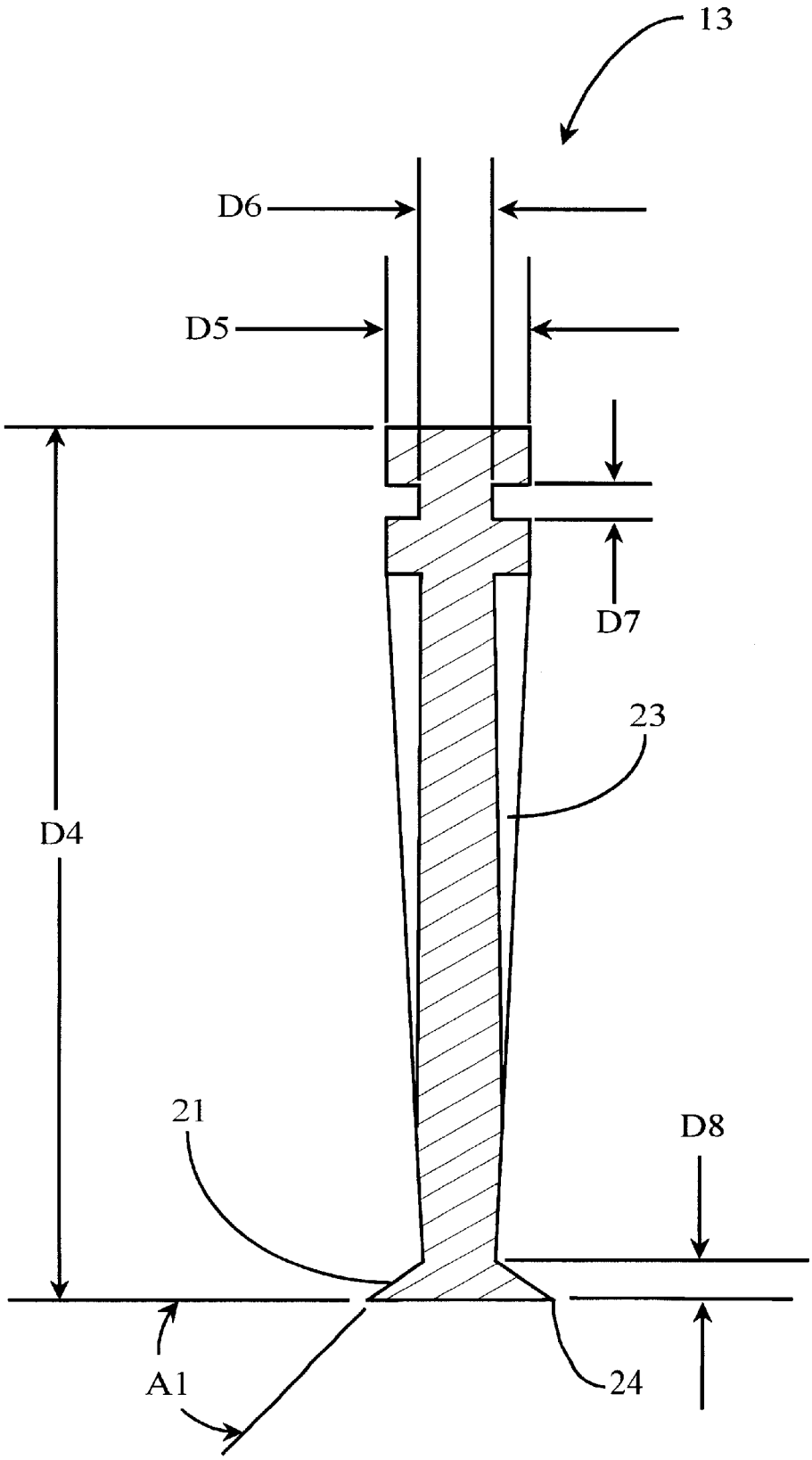
FIG. 3 is a cross section view of the water blade insert of FIG. 2 taken along section line 3—3 of FIG. 2 in an embodiment of the present invention.

FIG. 2 is a broken elevation view of blade insert 13 of FIG. 1 in an embodiment of the present invention showing approximate dimensions and various molded features, some of which are important to unique functionality of wiper blades in embodiments of the present invention. FIG. 3 is a section view of blade insert 13 taken along section lines 3—3 of FIG. 2 wherein further dimensioning is illustrated.

A lip region 21 is provided along the longitudinal bottom edge of blade insert 13 with lip elements extending laterally from the bottom edge. This lip region may be formed in several different ways in different embodiments of the invention. In a preferred embodiment the lip region is formed at an angle from the blade element as described below in more detail.

In a preferred embodiment of the present invention blade insert 13 is molded from a silicon rubber material via injection molding process for similar reasons stated as stated above with respect to the molding of handle sections 17 and 15. It will be apparent to one with skill in the art that blade insert 13 may be molded from other materials known in the art and of suitable flexibility. In this instant embodiment, the inventor prefers silicon rubber with a flexibility rating of approximately 30 to 70 durometer, depending on thickness of the blade. The flexibility of blade insert 13 can be more or less than 30 to 70 durometer, depending on a number of factors that also affect functionality, such as blade thickness, taper, grooving, blade height, and the like.

A unique and critical function provided by unique characteristics of blade insert 13 is it's capability of conforming around sometimes compound and/or radical curves in the body of an automobile, such as in a fender section. It is an object of the present invention is to provide for eliminating standing water in these areas in a safe and efficient manner. This unique capability is made possible in part by the approximate dimensional proportions of blade insert 13 with respect to length and height.

Referring to FIG. 2 and FIG. 3, blade 13 has a height D4 that is a significant fraction of length D1. The ability of blade 13 to form around curved surfaces in wiping water from such surfaces is largely due to the height of the blade relative to the length, and this feature is enlarged upon below. In one preferred embodiment of the present invention, D12, which is the effective height of the blade extending from a handle, is about 2½ inches. This dimension is the free flexible height from bottom of blade insert 13 to the bottom of the grip handle formed by handle sections 15 and 17 of FIG. 1. In this embodiment D1 is about 12 inches. The ratio of free height to length in this case is about 0.21, or about 20 twenty percent. The inventor has discovered empirically that this ratio need to be about ten percent or more for the water blade to be really useful for automobiles with considerable curved surfaces.

It will be understood that D1 is used in this embodiment both as the length of the handle sections and the wiper blade, as the lengths are substantially the same. In some other embodiments handle elements and wiper blades will be of different dimensions. It has been found by experiment that in this embodiment, the dimensions 2.5 inches for height D12 and 12 inches for D1, with a thickness of material of approximately 3/16 of an inch produces a useful and preferable result. In other embodiments wherein the overall dimensions of water blade 11 are larger or smaller, a material with a more suitable hardness and perhaps thickness may be employed to aid in achieving desirable flexing properties of water blade 11.

Providing a significant height for blade insert 13 increases the area of contact around a curved automobiles surface such as a fender, and the like. The ratio of height to length of blade insert 13 is important to the function of water blades in various embodiments of the present invention, and will be described in more detail in below.

Another important characteristic in blade insert 13 is a capability to direct standing water from a surface and to move it in an efficient manner whereby virtually no water residue remains behind on the automobile surface. This directing effect is accomplished by lip 21 which is formed along the longitudinal bottom edge of blade insert 13 and extends in the embodiment shown in the form of a tapered angle on either side. Angled lip 21 produces a rolling action to the water and forces it to ride up on the angled surface of the lip effectively separating the water from the surface of the automobile. It is known to the inventor that some windshield wiper blades incorporate a similar design, and it is well known in the art that this design is effective in removing standing water.

The angled lip characteristic is unique in conjunction with the height of the blade, in providing a lipped blade with an ability to conform to compound and radical curves in the surface of an automobile.

In the embodiment shown in the figures a series of molded indentions 23 is provided along the length of blade insert 13. The object of these indentions is to minimize the amount of material required to mold blade insert 13. It is known in the art that silicon rubber is relatively expensive when compared to other materials, therefore, considerable savings can be realized by employing such material reducing techniques. In the embodiment shown these indentions are equally spaced approximately ½ inch (D13) from center line to center, for 24 indentions. The uniform height of these indentions is approximately 1⅞ inches (D1), and the dimension from the bottom of the indentions to the bottom of blade insert 13 is approximately ½ of an inch (D10).

Even though indentions as described immediately above may be used for saving weight and material volume, in most preferred embodiments the sides of blade 13 are smooth, rather than grooved, and the inventor has found that the smooth embodiment actually provides enhanced water-wiping function compared to blades with the grooved surface.

A groove 25 is shown running the entire length of blade insert 13. Groove 25, described briefly with reference to FIG. 1, is formed around the perimeter of blade insert 13, providing the shape of T-section 18. These grooves provide a secure locking arrangement when handle sections 15 and 17 of FIG. 1 are closed, thereby stopping blade insert 13 from moving up or down with respect to the grip handle.

The overall thickness of blade insert 13 is approximately ½ of an inch (D5). A minor thickness of blade insert 13 shown from the inside diameter of T-slot 25 and extending down to the upper shoulder of angled lip 21 is approximately 3/16 of an inch (D6). Overall height of blade insert 13 is approximately 2 and ⅞ inches (D4). The width of grooves 25 of and the height of angled lip 21 are approximately ⅛ of an inch (D7 and D8 respectively). The approximate angle of angled lip 21 in the preferred embodiment shown is 30 degrees (D9). In some embodiments the angle at which lip 21 joins the body of the blade is different, and in some embodiments the lip may be on one side only. The inventor has found that a sharp edge 24 at the end of lip 21 provides a superior wiping action.

Various dimensions as described herein are approximate only and are meant to illustrate preferred size relationships of features of blade insert 13 in a preferred embodiment of the present invention. It will be apparent to one with skill in the art that many changes can be made with respect to dimensioning water blade 11 without departing from the spirit and scope of the present invention. For example, a larger water blade may be used on a larger vehicle such as a semi-trailer rig and so on. In one embodiment a water blade with an added height to its blade insert may be used, for example, if a particular type of vehicle contains more curved features that are pronounced.

Figure 4A:
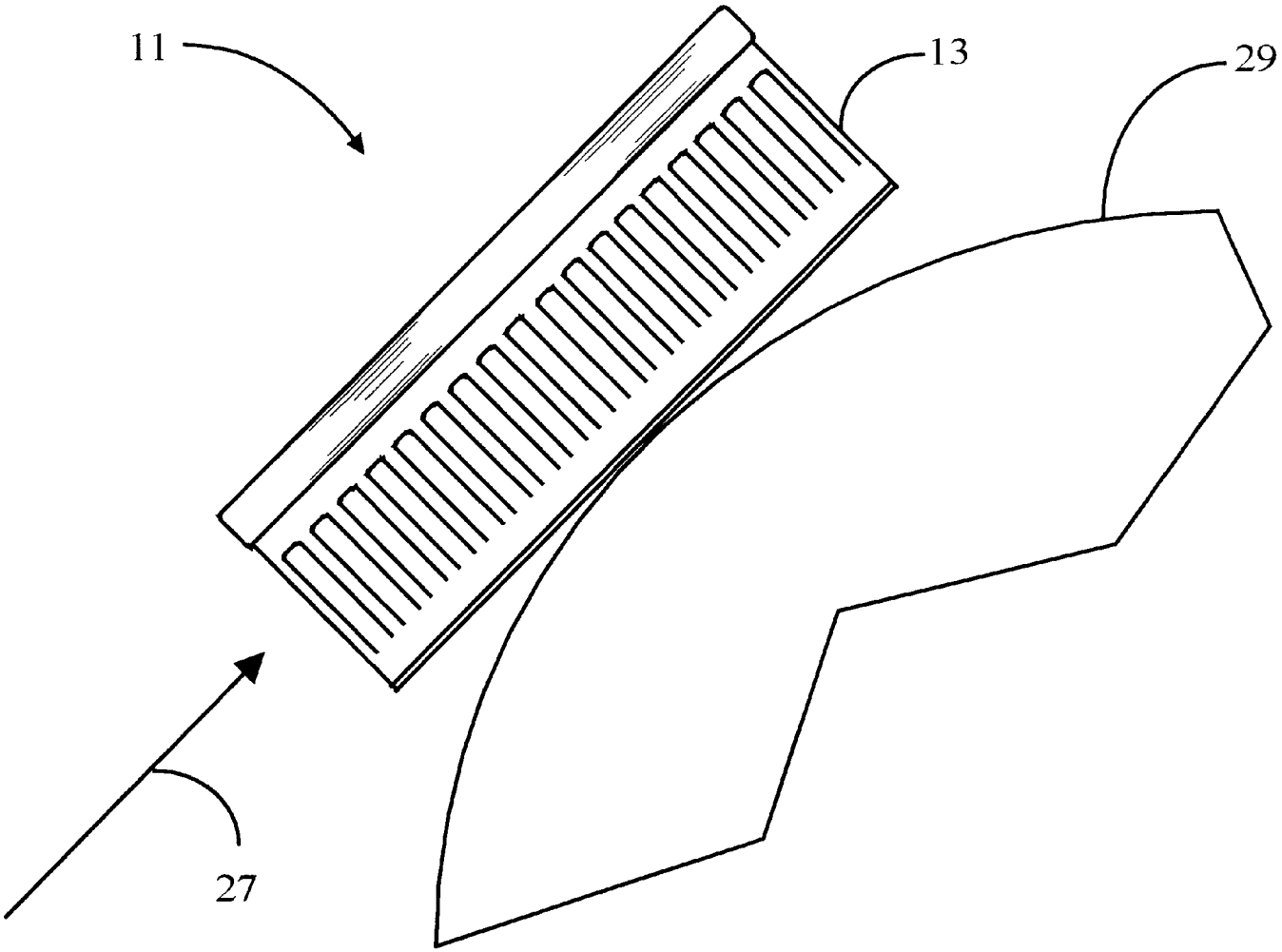
FIG. 4A is a perspective view of the water blade of FIG. 1 applied to a curved surface, with the blade just touching the surface.
Figure 4B:
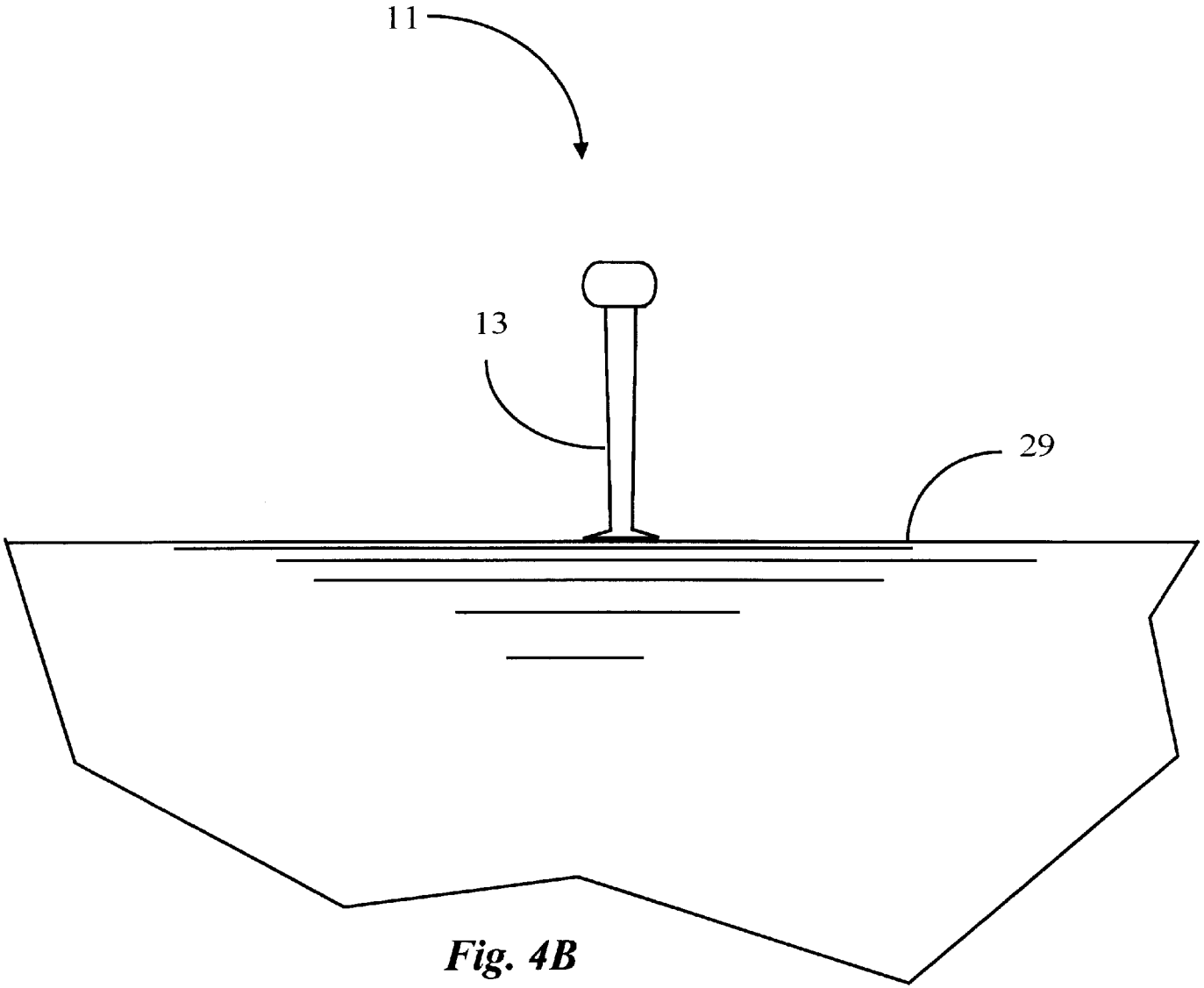
FIG. 4B is a view of the blade and surface of FIG. 4A from a different vantage.
Figure 4C:
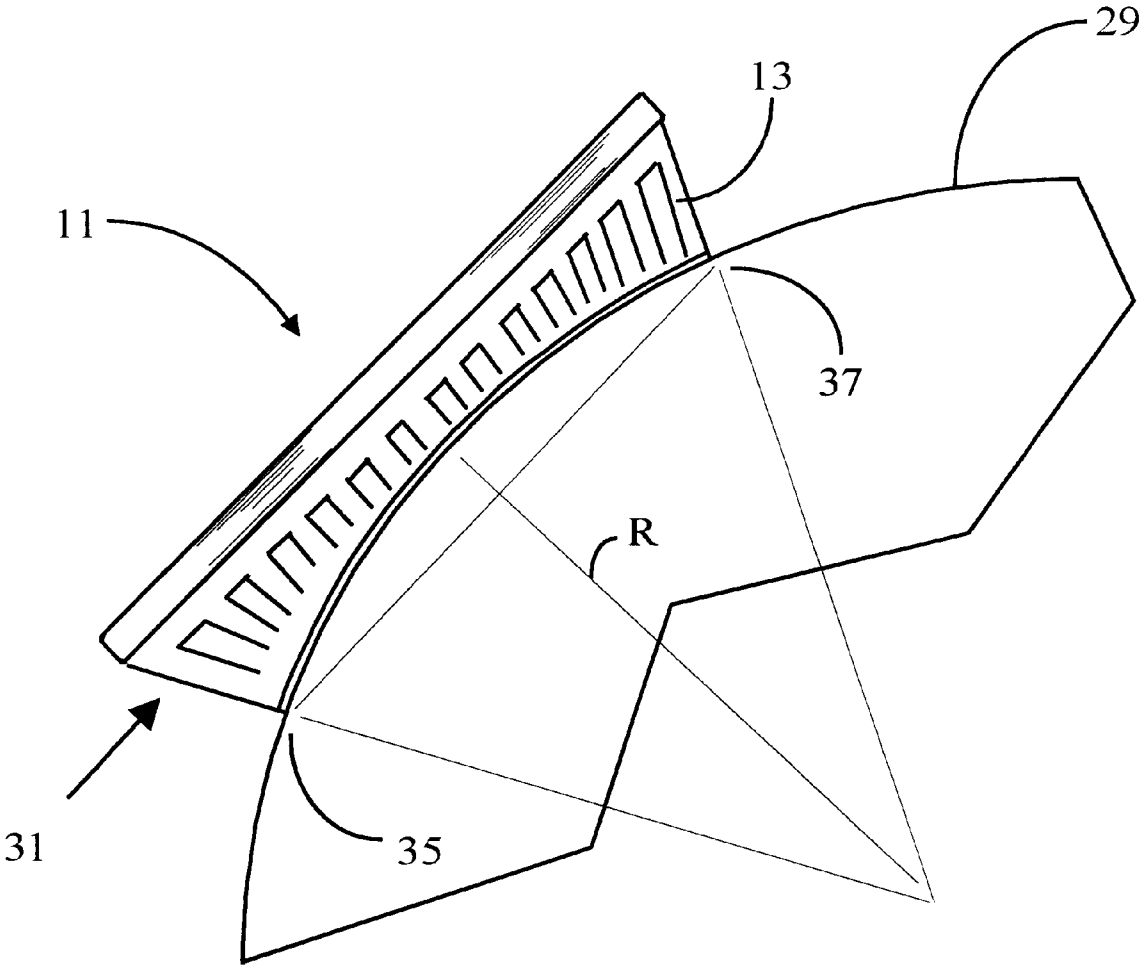
FIG. 4C is a perspective view of the blade of FIGS. 4*a* and 4B with the blade urged into the surface.

FIGS. 4A–4C illustrate the unique action of water blade 13 in conforming to a curved surface 29. FIG. 4A illustrates a section view of a curved surface, which could be the curvature of a fender, and a water blade 11 including a rigid handle positioned so that lip 21 is just in contact with the curved surface, but flexible blade element 13 is not deformed. FIG. 4B is a view in the direction of arrow 27 of FIG. 4A, showing water blade 11 in contact with curved surface with blade element 13 not deformed. In this example, the contact of the blade element with the surface is just a narrow line. This is the situation that will always exist with a blade having little or no height D12 (FIG. 2).

Figure 4D:
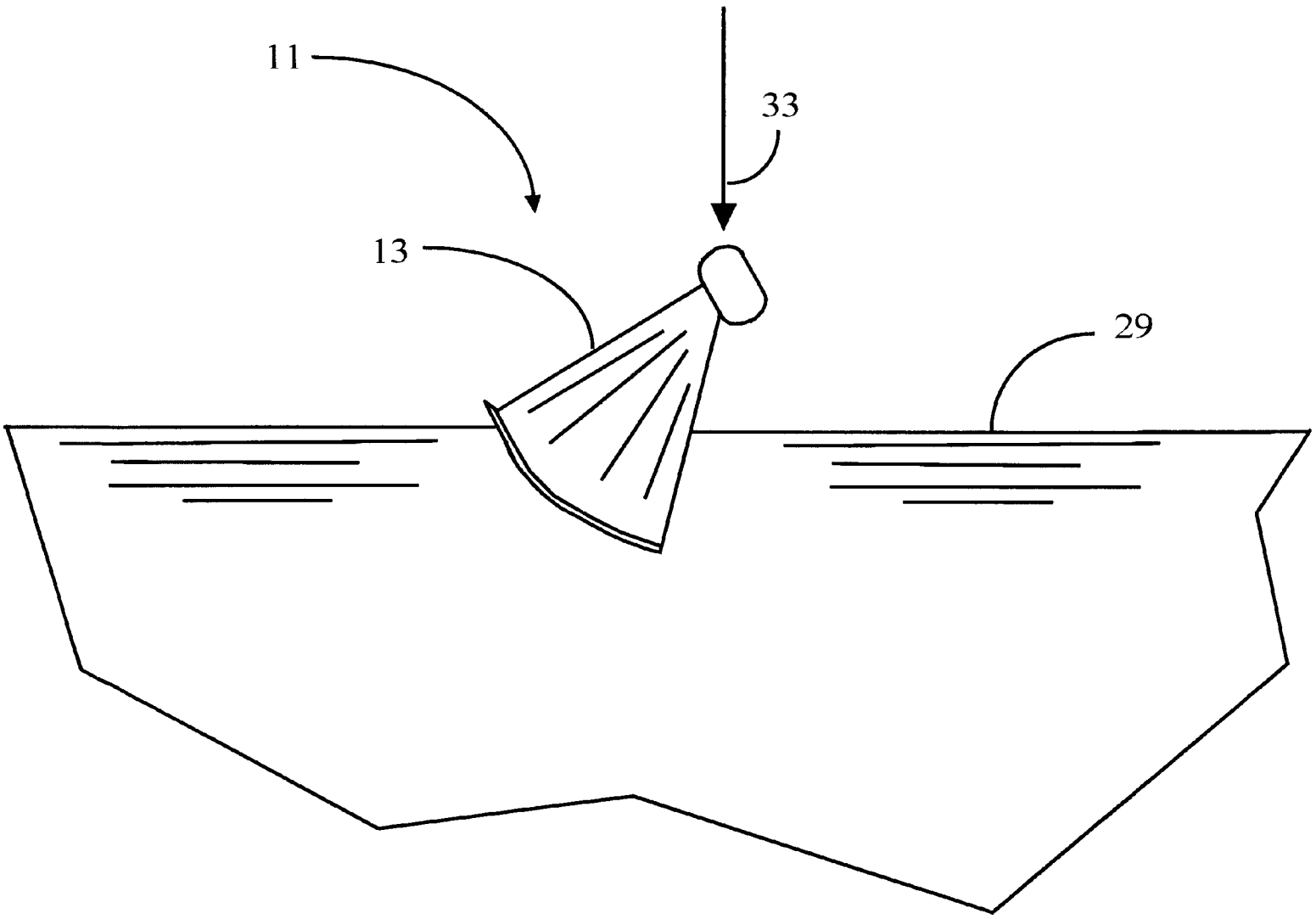
FIG. 4D is a view of the blade and surface of FIG. 4C from a different vantage.

FIG. 4C is the same section view of a curved surface 29 as shown in FIG. 4*a*, with water blade 11 in contact with surface 29, and FIG. 4D is a view in the direction of arrow 31. In this example, blade 11 has been rotated somewhat around the longitudinal axis of the handle, and the blade has been urged toward curved surface 29 in the direction of arrow 33. This movement is applied by a user holding the blade in his or her hand.

The result of moving the water blade into surface 29 is deformation of blade element 11, bringing the sharp edge of lip region 21 into contact with the surface, and causing flexible blade element 13 to wrap around the curvature of the surface to a significant degree. In this example, width of the contact area (FIG. 4C) is from point 35 to point 37. The significantly wide contact line around the curvature of the surface is a result of the height D12 (FIG. 2) of flexible blade element 13.

The arc length that may be accomplished by blade element 13 around a curved surface in practicing the present invention is a function of both the height of the blade element and the curvature of the surface. As surface curvature may be varied and compound, rather than simple, the calculations can be complex. A simplified example is given here assuming that the curvature is circular of radius R.

Given radius R for the curvature of the surface, and a height H for dimension D12 of blade element 13, and assuming that the water blade is urged into the curved surface until the handle is proximate the surface (which is a max situation, not actually encountered in practice), the angle $\alpha$ can be determined by the formula:

$$\sin \alpha = (R-H)/R$$

The potential length of the contact line to the curved surface from point 35 to point 37 in this situation can then be calculated as that portion of the circumference of a circle of radius R subtended by twice the angle $\alpha$ taken around the center of the curvature.

It is apparent in the above analysis that for the potential length of the contact line to be realized, the overall length of the flexible blade element must be at least equal to the potential length. If the length of the blade element is more than the potential contact length, then part of the blade element will not make contact, as is shown in FIG. 4C. As is described above, in the preferred embodiment shown, the height of the blade element is about 3 inches, and the length is about 12 inches. This relationship has been found by the inventor to be useful for most automobile bodies.

Figure 5A:
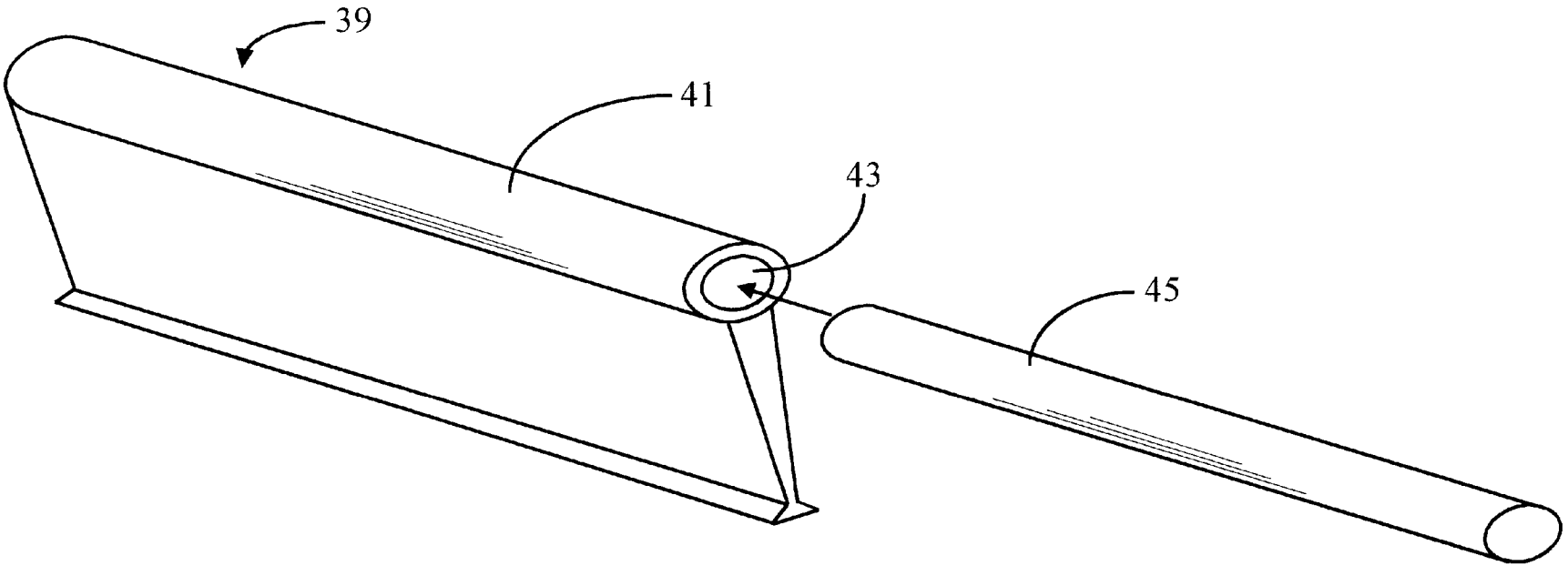
FIG. 5A is a perspective view of an alternative embodiment according to the invention, including a molded passage and insert for a rigid handle.

It will be apparent to those with skill in the art that there are many alterations that might be made in the embodiments shown and described without departing from the spirit and scope of the present invention. In the area of handle provision for water blades in particular, many variations have been developed. FIG. 5A is a perspective view of one such alternative embodiment. In FIG. 5A a water blade 39 according to an embodiment of the present invention is molded from material such as silicone material of a single durometer, and a handle portion 41 is molded integrally from the same material. In the molding process a lengthwise passage 43 opening to either or both ends is molded into the water blade. After molding a rigid stiffener 45 of about the length of the water blade is inserted into the lengthwise passage, and provides rigidity and the function of the rigid handle added according to FIG. 1.

Figure 5B:
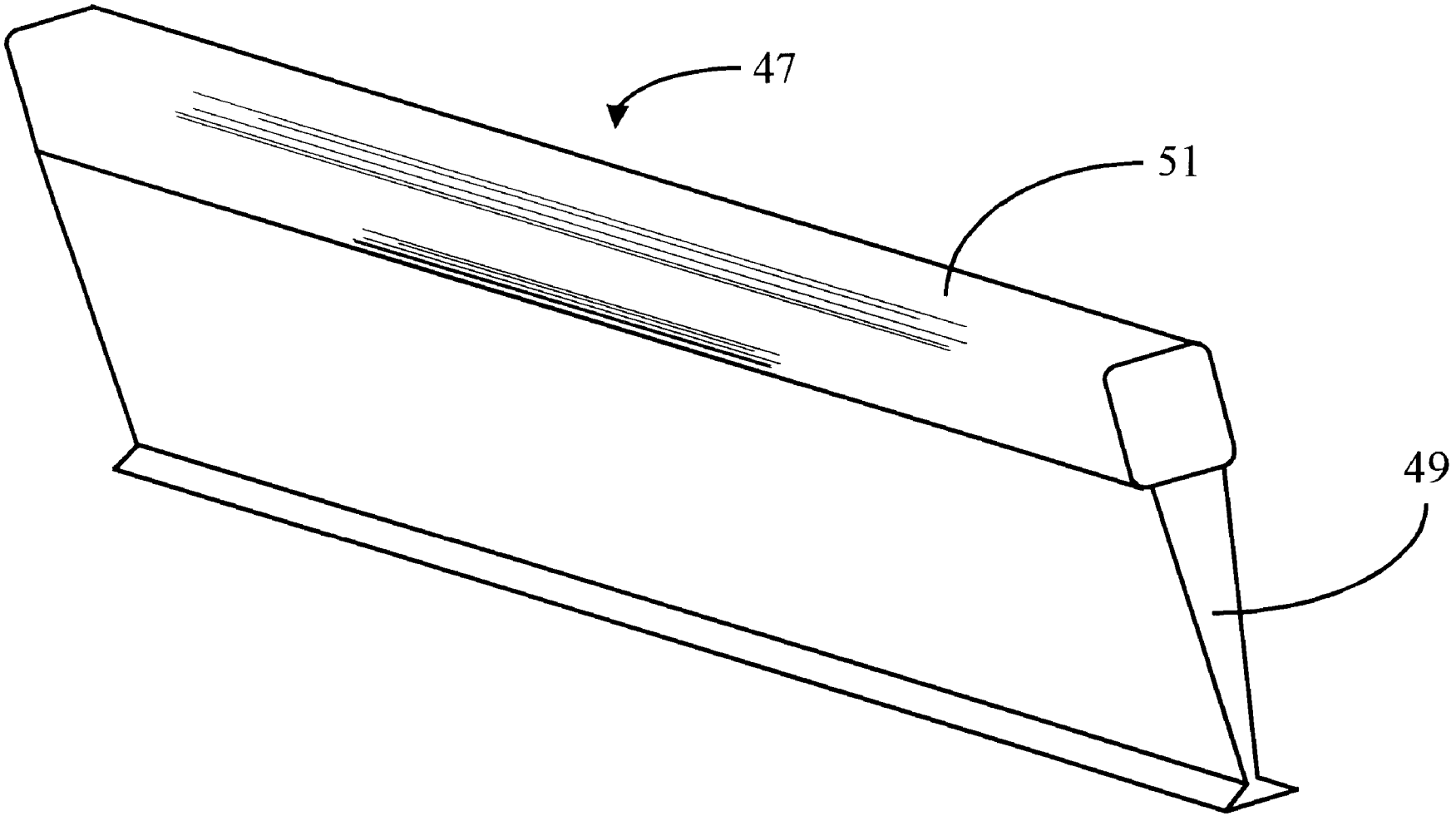
FIG. 5B is a perspective view of a two-part molded blade and handle according to an alternative embodiment of the present invention.

FIG. 5B shows yet another handle alternative for a water blade 47. In the embodiment of FIG. 5B material of two different durometers are molded in one mold. A blade region 49 is molded of a material soft enough for the needed flexibility, and a more rigid material is molded as a handle region 51. Procedures for such molding are well-known known in the art.

Effective Water Removal (Displacement) Over Rivets and Other Projections

In an other aspect of the invention, the lip area of water blade insert 13, shown as element 21 in FIG. 1, is especially implemented to provide for effective water removal (displacement) when used on surfaces that have projections emanating from the surface, such as rivet heads, raised ornamental patterns, and the like.

Figure 6:
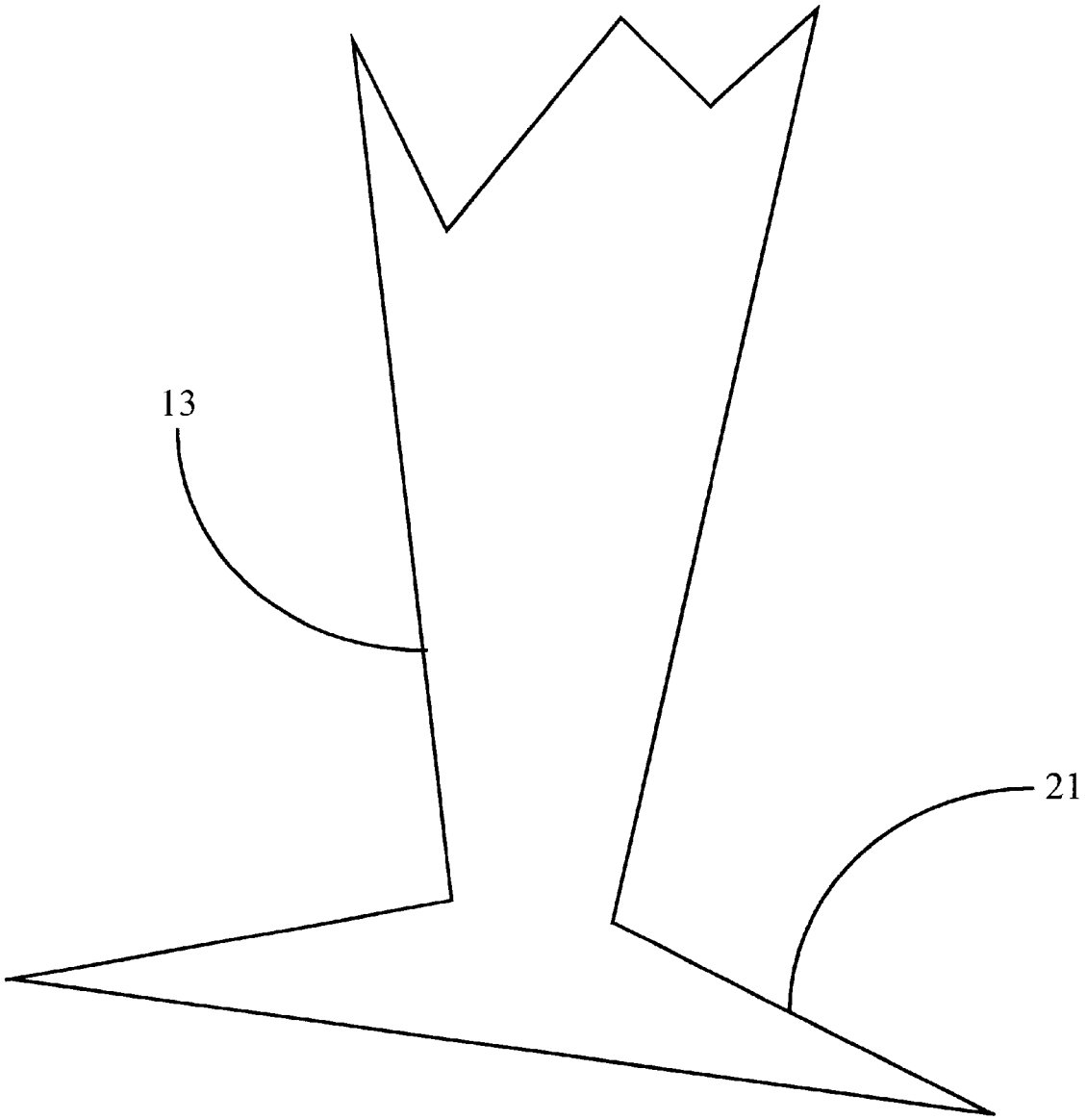
FIG. 6 is an end view of the lip area of the water blade of FIG. 1 according to an embodiment of the present invention.

FIG. 6 is an exploded and broken view of lip 21 of water blade insert 13 of FIG. 1 according to an embodiment of the present invention wherein lip 21 is not orthogonal to the height of the blade, but at other than a right angle.

It was mentioned above that some windshield wiper blades, known to the inventor, have lip regions that are similar in design to lip 21 of FIG. 1, and are known to be effective for removing standing water. However, it is also known and accepted in the art that a windshield wiper is limited by design and rigidity of material in that it is effective for a slightly curved and smooth surface such as a windshield. It was also mentioned above that the shape of lip 21 combined with the height of blade insert 13 is unique in it's ability to conform to and remove water from compound and radical curves in the surface of an automobile. This unique capability of water removal inherent to lip 21, as previously taught, is not limited only to contours and curves such as are common to surfaces of automobiles, trucks and other vehicles, but also extends, in some embodiments, to projections from surfaces as found in rivets, diamond plate, and other ornamental features found on some automobile surfaces, airplane surfaces, truck surfaces, and many other like surfaces that may or may not be associated with a type of vehicle, as is taught below.

The flexing capabilities of blade insert 13 and lip 21 also play a major roll in the ability of water blade 11 to remove water from more difficult surfaces such as surfaces exhibiting rivet heads, diamond pattern, and so forth. For example, with the applied action of water blade 11 over a given surface that may be contoured and have a raised pattern such as a diamond head pattern, blade insert 13 will conform to the contour while the contact side of lip 21 will conform to and around the edges of the diamond pattern effectively removing water. Lip 21, for example, may be specially designed with the required length (extension from the body of blade 13) for extending more than the total raised height of an ornamental pattern or an array of rivets and so on.

Figure 7A:
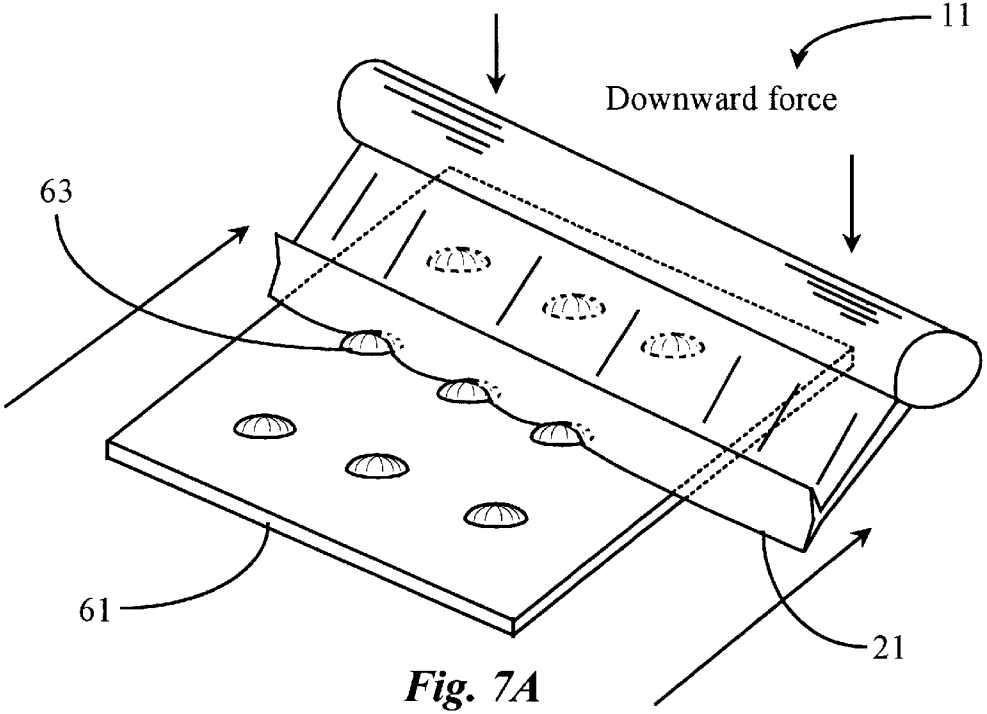
FIG. 7A is a perspective view of the water blade of FIG. 1 displacing water from a diamond plate surface according to an embodiment of the present invention.

FIG. 7A is a perspective view of the water blade of FIG. 1 removing (displacing) water from a surface having rivet-head projections according to an embodiment of the present invention. In this embodiment, a user urges water blade 11 across a surface 61 having projecting rivet heads 63 in the direction of the arrows while, at the same time, keeping a sufficient downward force on surface 61 to cause the lip to conform to the shape of the raised rivet heads. As one side (contact side) of lip 21 passes over a rivet head 63, the flexible material conforms to the shape of each of the raised regions. In this fashion, water is displaced from all areas exposed to lip 21 including regions in between raised rivet heads of surface 61.

Figure 7B:
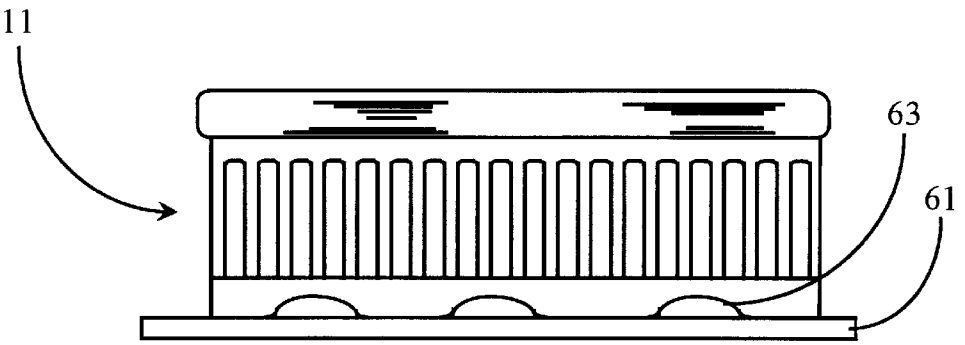
FIG. 7B is an elevation view of the water blade and diamond plate of FIG. 7A.

FIG. 7B is an elevation view of water blade11 and rivet-studded surface 61 of FIG. 7A. When viewing water blade 11 and surface 61 in the direction of motion as indicated by the directional arrows of FIG. 7A, one can see how tightly lip 21 conforms around raised regions such as those present on surface 61. This unique ability is due to the flexibility of the material and design of lip 21 wherein sufficient length and flexibility is provided for conforming around such shapes. It will be apparent to the skilled artisan that one angular side or portion of lip 21 may be formed of a substantially greater length than the opposing side so that dual use is provided to water blade 11 without departing from the spirit and scope of the present invention. For example, one side having a longer extension may be used for surfaces having raised regions while the opposing shorter side used for smooth surfaces and so on. In alternative embodiments alternate designs are provided to the lip section of blade 11 to conform to even more complex surface features as taught below.

Figure 8A:
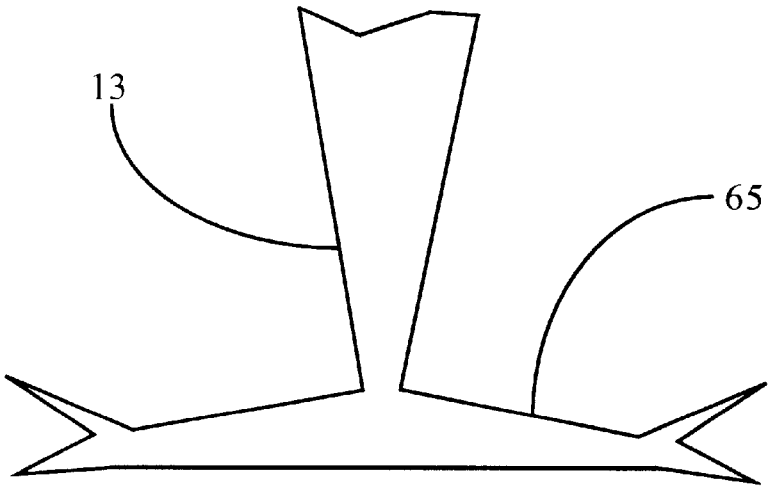
FIG. 8A is an end view of a lip design according to another embodiment of the present invention.

FIG. 8A is an end view of a lip shape according to another embodiment of the present invention. In this example, a lip section 65 is formed having a v shape configuration on each opposing end. As is the case with lip 21 of FIG. 1, the v form is made to extend along the longitudinal edge of blade insert 13 of FIG. 1. This v formation produces a double-edge effect providing a second swipe at a surface during one initial pass of water blade 11.

Figure 8B:
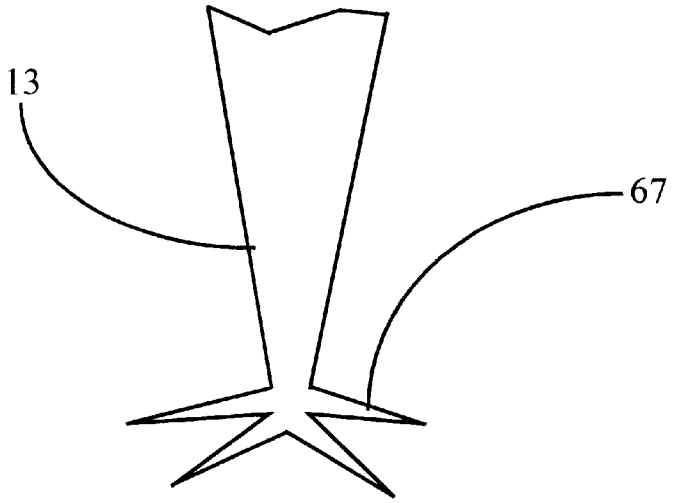
FIG. 8B is an end view of a lip design according to yet another embodiment of the present invention.

FIG. 8B is an end view of a lip design according to yet another embodiment of the present invention. In this example, a lip section 67 is formed having a v shape similar to lip 65 of FIG. 8A accept that the opposing formations are much closer together. Such a formation may be used, for example, when raised areas or portions of a surface are not particularly high therefore not requiring substantial length with regard to lip formation.

Figure 8C:
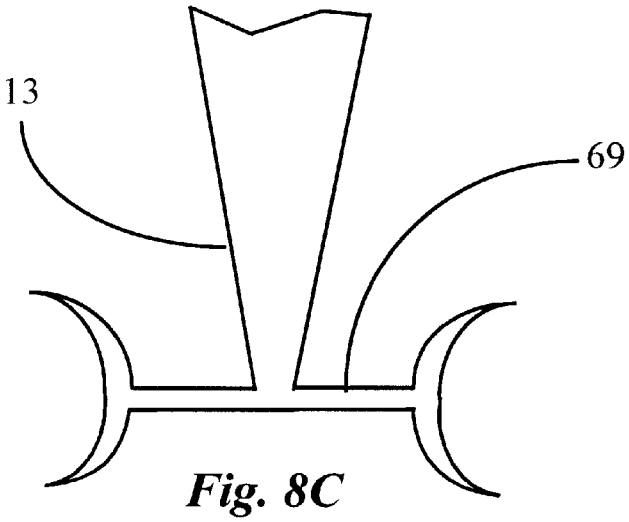
FIG. 8C is an end view of a lip design according to still another embodiment of the present invention.

FIG. 8C is an end view of a lip design according to still another embodiment of the present invention. In this example, a lip 69 is formed having a half-moon shape on opposing ends and a substantially straight bridge connecting the half-moon shapes to each other. As with the previous two examples, there are now two swiping edges that are able to make contact with a surface during one pass with blade 11. A formation such as seen in this embodiment may be useful for a surface that has a series of rounded rows forming a ribbed surface. The formation shown here would allow bi-directional motion of water blade 11 such as across the rows and down the rows wherein water removal is successful in either direction.

Figure 9:
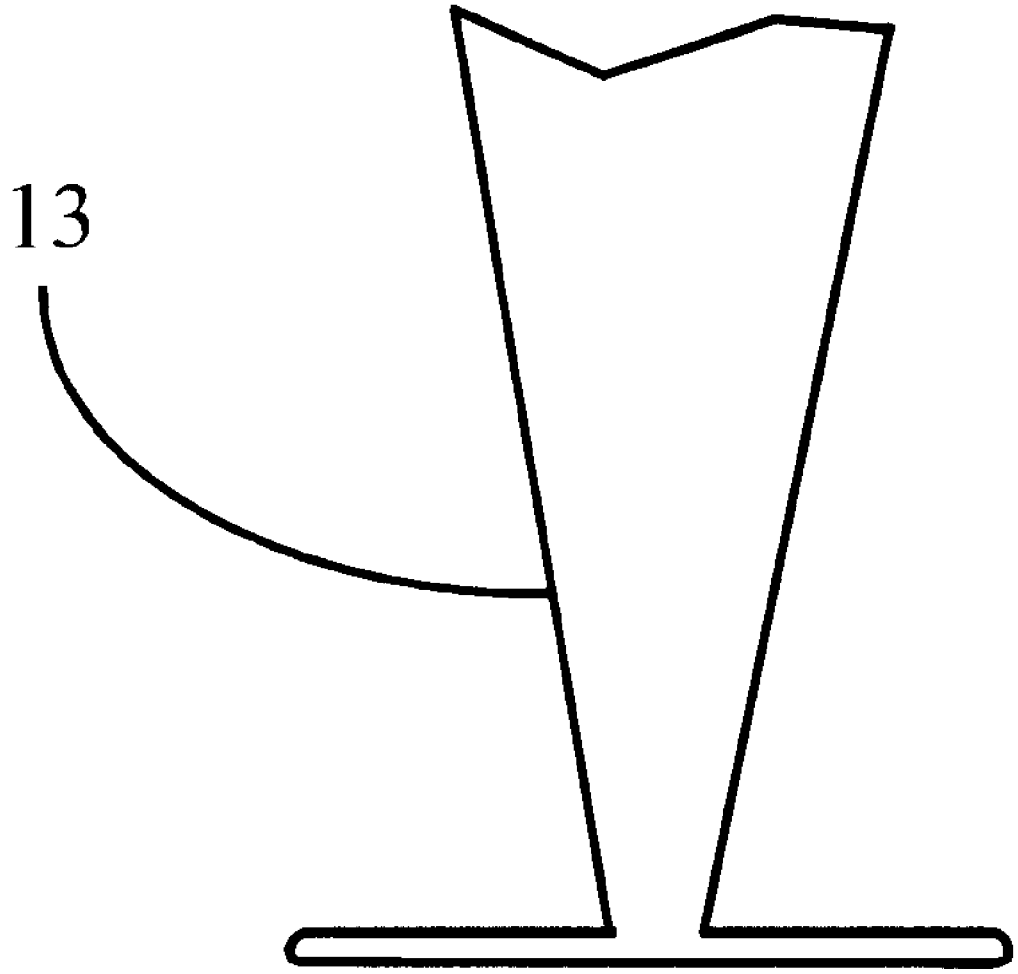
FIG. 9 is an end view of yet another embodiment of the present invention.

FIG. 9 is an end view of yet another, and simpler, embodiment of the present invention. In this embodiment the lip is a simple straight projection forming an orthogonal T-bar at the bottom of blade 13, the T-bar having essentially constant wall thickness.

It will be apparent to one with skill in the art that examples shown in FIGS. 8A–C and 9 are merely a few of many possible lip-design variations that may be implemented without departing from the spirit and scope of the present invention to provide for conforming to complicated shapes on surfaces to be processed with a wiper blade as taught herein.

In another example of alternative embodiments, larger or smaller water blades may be desirable for certain situations. For example, larger blades may be provided for use with large vehicles, such as tractor/trailer rigs and the like, or for vans and other trucks. In some embodiments, especially for use with large vehicles or other entities with large body areas, interfaces may be provided for handle extensions and the like, to allow a user to present the blade to otherwise hard-to-reach areas. Such interfaces might include such as ball and socket joints for flexibility in positioning a water blade in relationship to a handle.

As another example, many different materials that could be used in the fabrication of a water blade in different embodiments. In other embodiments blade inserts may be of differing heights and lengths and may be sold separately to be inserted into one handle grip and so forth. The breadth of the present invention is limited only by the claims that follow.

What is claimed is:

1. A water-wiping apparatus for wiping standing water from a surface having deliberate protuberances selected from a group consisting of rivet heads and diamond patterns, comprising:

a flexible panel having a thickness, a length, and a height at least ten percent of the length, with an upper long edge and a lower long edge substantially parallel;

a substantially rigid handle attached along at least a portion of the upper edge; and a lip region formed along the lower long edge, extending to one side of the flexible panel and ending in a sharp line at the end away from the flexible panel the lip region having a shape and flexibility enabling it to conform to the said protuberances;

wherein as the flexible panel translates substantially parallel to the surface, the lip region forms around the said protuberances from the surface as the flexible panel passes over the said protuberances.

2. The water-wiping apparatus of claim 1 wherein the lip region has a triangular cross-section in a plane cutting the panel orthogonal to the length and parallel to the height.

3. The water-wiping apparatus of claim 1 wherein the lip region has a rectangular cross-section in a plane cutting the panel orthogonal to the length and parallel to the height.

4. The water-wiping apparatus of claim 1 wherein the flexible panel has a greater thickness at the upper edge than at the lower edge.

5. The water-wiping apparatus of claim 1 wherein the flexible panel is molded from silicone material.

6. The water-wiping apparatus of claim 1 wherein the lip region extends to both sides of the flexible panel.

7. The water-wiping apparatus of claim 1 wherein vertical side-by-side grooves are provided along the length of the flexible panel to lower the volume of material in the panel.

8. The water-wiping apparatus of claim 1 wherein the handle is adapted to be joined to a handle extension.

9. The water-wiping apparatus of claim 1 wherein the lip region ends at the edge away from the flexible panel in multiple v-shaped projections.

10. The water-wiping apparatus of claim 1 comprising multiple lip regions extending from the lower edge of the flexible panel in different directions.

11. A blade insert for a water-wiping apparatus for a surface having deliberate protuberances selected from a group consisting of rivet heads and diamond patterns comprising:

a flexible panel having a thickness, a length, and a height at least ten percent of the length, with an upper edge and a lower long edge substantially parallel;

a handle interface along the upper edge adapted to join the flexible panel to a rigid handle; and a lip region formed along the lower long edge, extending to one side of the flexible panel and ending in a sharp line at the end away from the flexible panel the lip region having a shape and flexibility enabling it to conform to the said protuberances;

wherein as the flexible panel translates substantially parallel to the surface, the lip region forms around the said protuberances from the surface as the blade insert passes over the said protuberances.

12. The blade insert of claim 11 wherein the handle interface comprises lengthwise grooves on opposite sides of the flexible panel.

13. The blade insert of claim 11 wherein the lip region has a triangular cross-section in a plane cutting the panel orthogonal to the length and parallel to the height.

14. The blade insert of claim 11 wherein the lip region has a rectangular cross-section in a plane cutting the panel orthogonal to the length and parallel to the height.

15. The blade insert of claim 11 wherein the flexible panel has a greater thickness at the upper edge than at the lower edge.

16. The blade insert of claim 11 wherein the flexible panel is molded from silicone material.

17. The blade insert of claim 11 wherein the lip region extends to both sides of the flexible panel.

18. A method for wiping standing water from surfaces having deliberate protuberances selected from the group consisting of rivet heads and diamonds patterns, comprising steps of:

(a) forming a wiper blade of a flexible material, the wiper blade comprising a flexible panel having a thickness, a length, and a height at least ten percent of the length, with an upper long edge and a lower long edge substantially parallel, and a lip region formed along the lower long edge, the lip region extending to one side of the flexible panel and ending in a sharp line at the end away from the flexible panel, the lip region having a shape and flexibility enabling it to conform to the said protuberances;

(b) attaching a substantially rigid handle along at least a portion of the upper long edge, the handle having a central long axis;

(c) placing the wiper blade against the surface with the lower long edge in contact with the surface;

(d) rotating the wiper blade about the handle axis such that the sharp line at the end of the lip region is in contact with surface;

(e) urging the wiper blade toward the surface; and (f) translating the wiper blade in a direction substantially parallel with the surface such that the lip region forms around the protuberances from the surface as the blade passes over the said protuberances.

* * * * *